United States Patent [19]

Knight

[11] Patent Number: 4,896,360

[45] Date of Patent: Jan. 23, 1990

[54] PUBLIC ADDRESS AMPLIFIER

[76] Inventor: Robert S. Knight, 47 High Street, Musselburgh, Midlothian EH21 7AD, Scotland, Great Britain

[21] Appl. No.: 199,415

[22] Filed: May 27, 1988

[30] Foreign Application Priority Data

May 27, 1987 [GB] United Kingdom ..... 8712469

[51] Int. Cl.[4] ..... H04R 27/00

[52] U.S. Cl. ..... 381/82; 455/349

[58] Field of Search ..... 381/88, 118, 112, 119, 381/169, 82, 83, 84, 85; 330/267, 65; 455/349

[56] References Cited

U.S. PATENT DOCUMENTS

| | | | |
|---|---|---|---|
| 3,706,852 | 12/1972 | Angus | 381/112 |
| 4,146,191 | 3/1979 | Cavanaugh | 381/169 |
| 4,471,651 | 9/1984 | Dimeff et al. | 73/40.5 A |
| 4,475,231 | 10/1984 | Elster | 381/88 |
| 4,524,452 | 6/1985 | Marshak | 381/119 |
| 4,546,267 | 10/1985 | Urfirer | 455/349 |
| 4,555,674 | 11/1985 | Palara et al. | 330/267 |
| 4,752,745 | 6/1988 | Pass | 330/267 |

OTHER PUBLICATIONS

Radio Shack 1986 Catalog, pp. 54 and 58, Models 32-2024, 32-2020, and 32-2028.

Audio Cyclopedia, pp. 611-613, 1979.

*Primary Examiner*—Forester W. Isen

*Attorney, Agent, or Firm*—Perman & Green

[57] ABSTRACT

A public address amplifier comprises a housing which contains an output amplifier connected to loudspeakers. A microphone containing a microphone transducer and an input amplifier is connected to the input of the output amplifier and to connectors on the housing by a cable. A second such public address amplifier can be connected to the first by connecting its cable to one of the connectors so as to provide a public address system of increased power.

8 Claims, 4 Drawing Sheets

PUBLIC ADDRESS AMPLIFIER

The present invention relates to public address amplifiers. The term "public address amplifier" as used herein includes any amplifier intended for use in a system for broadcasting sound to an audience or in a sound reinforcement system.

In known public address systems, an amplifier is connected via respective cables to remote speakers and a microphone. If the amplifier does not contain its own power source, a further cable is needed to connect it to an external source such as a car battery or, when available, the alternating current mains. The connection of such cables to the parts of the system is difficult for a non-expert user, and the amount of cabling is untidy and inconvenient.

It is difficult to expand such a system. Increasing the number of loudspeakers connected to the amplifier can cause impedance mis-matching, overloading, and distortion, and the available output power is limited by the amplifier. Further amplifiers may be connected in the system, but this increases the complexity and volume of interconnections making use by non-experts even more difficult.

Many known public address amplifiers are battery operated. However, such amplifiers have substantial bias or quiescent currents which drain the battery and reduce its life or the periods between recharging.

According to a first aspect of the invention, there is provided a public address amplifier comprising a housing, an output amplifier located in the housing for driving a loudspeaker, an input amplifier whose output is connected to the input of the output amplifier, and a connector located at the housing and connected to the output of the input amplifier for connection to the input of a remote output amplifier.

Preferably a microphone transducer is connected to the input of the input amplifier, the microphone transducer and the input amplifier are located in a microphone body, and the output of the input amplifier is connected via a cable to the input of the output amplifier. Preferably the input amplifier has a gain control operable at the microphone body. Preferably the cable is captive in the housing. Preferably the housing contains a cable store and manual winding means for winding the cable into the cable store. Preferably the winding means comprises a handle arranged to rotate a pair of wheels entraining the cable therebetween. Preferably the winding means includes a clutch for disengaging the handle when the cable is withdrawn from the cable store.

Preferably the input amplifier includes an output stage whose load resistor is located in the housing. Preferably the output stage is an emitter follower.

Preferably the output amplifier includes a power supply control circuit for reducing the bias current of the output amplifier in the absence of any signal at the input of the output amplifier.

Preferably the housing is provided with connection means connected to power supply lines of the input and output amplifiers. Preferably the connector includes the connection means. Preferably the housing contains a rechargeable battery connected to the power supply lines.

Preferably the housing contains at least one loudspeaker connected to the output of the output amplifier.

The invention will be further described, by way of example, with reference to the accompanying drawings, in which.

Figure 1:
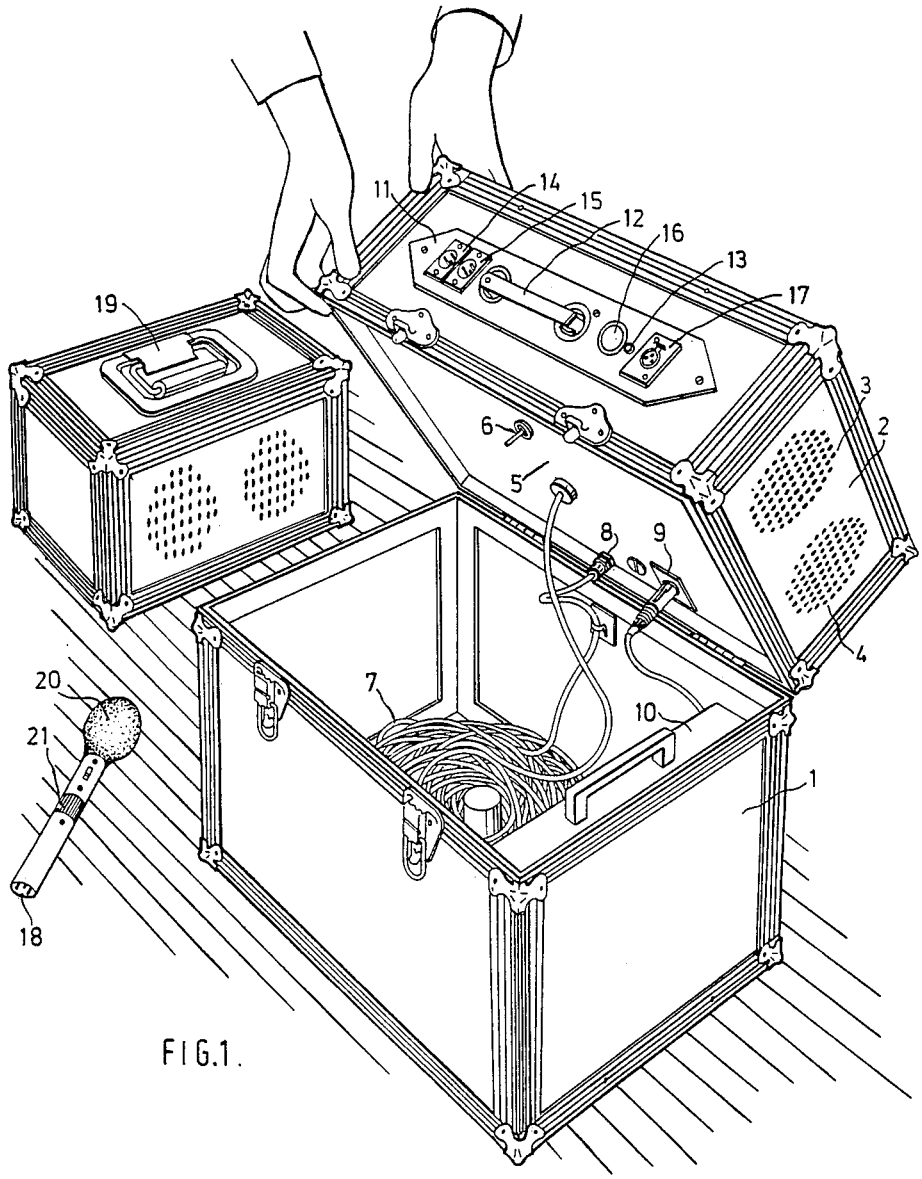
FIGS. 1 and 2 are external views of a public address amplifier constituting a preferred embodiment of the invention.

The public address amplifier shown in FIG. 1 comprises a flight case having a base 1 to which is hinged a lid 2. The lid 2 houses a pair of loudspeakers behind grills 3 and 4 within an enclosed compartment which also contains the electronics. This compartment is closed off by a wall 5 on which is mounted an on/off switch 6 and through which a signal and power cable 7 passes. The local end of the cable 7 returns through the wall 5 at 8 and is connected to the electronics within the enclosure. A connector 9 connects the electronics to a rechargeable battery pack 10 removably located within the base 1.

A panel 11 is mounted on the lid 2 and contains a cable winder 12 for winding in the cable 7. The cable winder 12 is shown in its stowed-away position in FIG. 1 and is shown in its operative position in FIG. 2. The panel 11 also carries an indicator light 13 for indicating when the amplifier is switched on and also the state of the rechargeable battery pack 10. The panel 11 further carries link sockets 14 and 15, whose purpose will be described hereinafter, a socket 16 for connection to a external power supply or battery charger, and an external speaker socket 17.

The base 1 is sufficiently large to accommodate the cable 7, which may for instance be of 33 meters in length, when fully rewound, together with a microphone 18 and a speaker 19 for deployment remotely from the flight case. Preferably there is also sufficient room to accommodate a folded down tripod base or mount for a telescopic or foldable stand for mounting the flight case above floor level.

Figure 2:
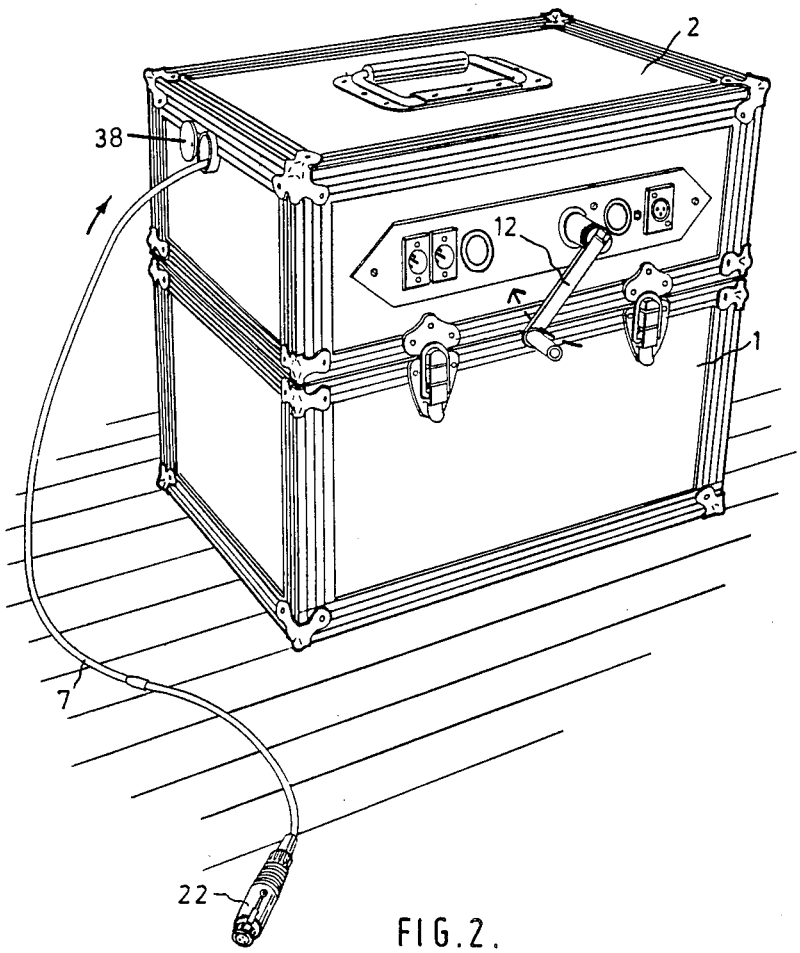

The microphone 18 has a integral or removable wind shield 20 and a volume adjustment sleeve 21. As shown in FIG. 2, the cable 7 is provided with a connector 22 for mating with an end connector of the microphone body.

Figure 3:
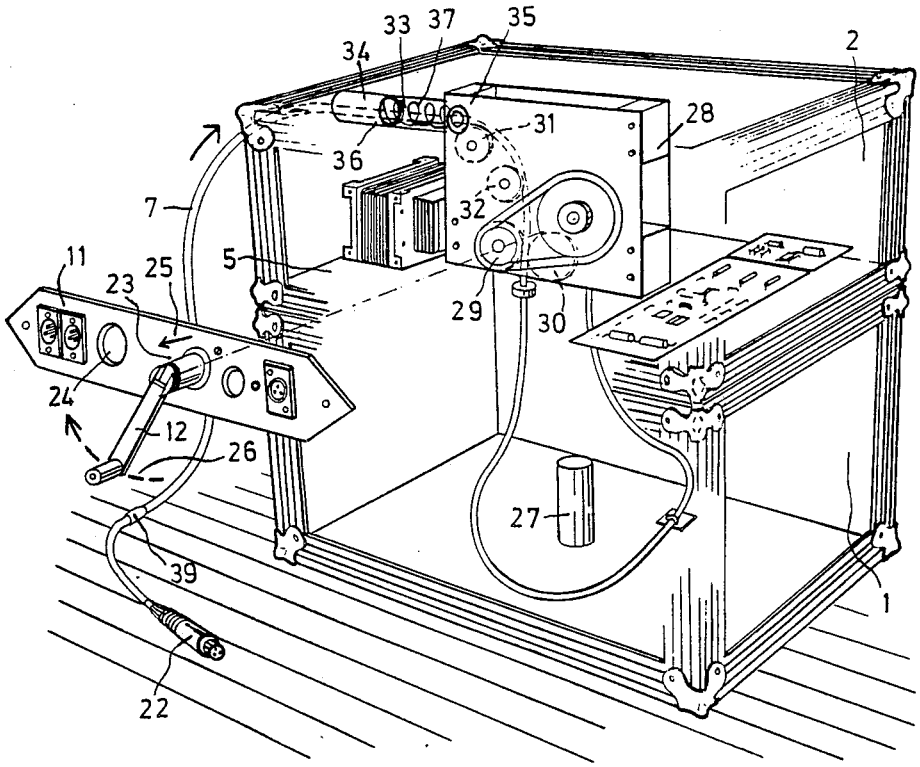
FIG. 3 is a cut-away diagrammatic view of the amplifier of FIG. 1.

As shown in FIG. 3, the cable winder 12 comprises a handle with an integral roller clutch 23. When not in use as shown in FIG. 1, the handle is folded over with its knob received in a recess 24 of the panel 11. When the winder is to be operated so as to wind the cable into the interior of the base 1, the handle is pivoted out to its operative position and the winder pulled in the direction of arrow 25. Winding the handle clockwise as indicated by the arrow 26 draws the cable 7 into the lid 2, through the wall 5, and into the base 1 where the cable automatically coils around a tripod stand mount 27.

The cable winder is connected via the drawn cup roller clutch 23 to the input shaft of a winding mechanism 28. The mechanism 28 comprises first and second wheels 29 and 30 having grooved peripheries arranged to grip therebetween the cable 7. The wheel 30 is driven via gears directly by the handle whereas the wheel 29 is driven by the handle via a transmission including a belt drive, so that the wheels 29 and 30 are driven at the same speed in opposite directions, when the handle 12 is rotated clockwise, to draw the cable 7 into the flight case. The mechanism 28 also comprises deep-grooved idler pulley wheels 31 and 32 for guiding the cable during winding and unwinding.

The lid contains an automatic cable ejector mechanism 33 comprising a tube 34 having an end plate 35 at its inner end, an axially slidable plate 36, and a compression coil spring 37 acting between them. The plates 35 and 36 have center holes and the cable 7 passes through these holes and along the axis of the spring 37. The external end of the tube 34 is provided with a rotatable cover 38.

The cable is stowed with the connector 22 inside the mechanism 33 and the cover 38 pivoted so as to close the tube 34. The length of the connector 32 is such that the plate 36 is retracted by the presence of the connector 22 inside the tube 34 against the action of the spring 37.

When the cable 7 is to be deployed, the cover 38 is rotated so as to open the tube 34. The connector 22 is therefore released and is ejected from the tube by the plate 36 and the spring 37. The connector and cable may then be pulled out to the desired length through the winding mechanism 28, during which operation the cable winder 12 is decoupled from the mechanism.

When the cable is to be retracted into the base 1, the cable winder is operated as described as hereinbefore and the clutch couples the winder to the input shaft of the mechanism 28. Winding continues until the connector 22 is withdrawn against the action of the spring 37 so that the cover 38 can be closed. A stop 39 is provided on the cable for co-operating with the wheels 29 and 30 so as to prevent damage to the connector terminations 22 when the cable is fully retracted. The winder is then folded away as described hereinbefore.

The drawn cup roller clutch 23 is preferably of the type made by Torrington, type number RCB.

The cable can therefore be readily deployed and retracted with the flight case closed as in FIG. 2. When deployed, the microphone 18 is merely plugged into the connector 22. This provides a very tidy arrangement for transporting and a simple arrangement for use by a non-expert. The gripping action of the wheels 29 and 30 provides effective traction for retracting the cable 7, even when the cable is wet or muddy, for instance when the public address amplifier is used outdoors.

Figure 4:
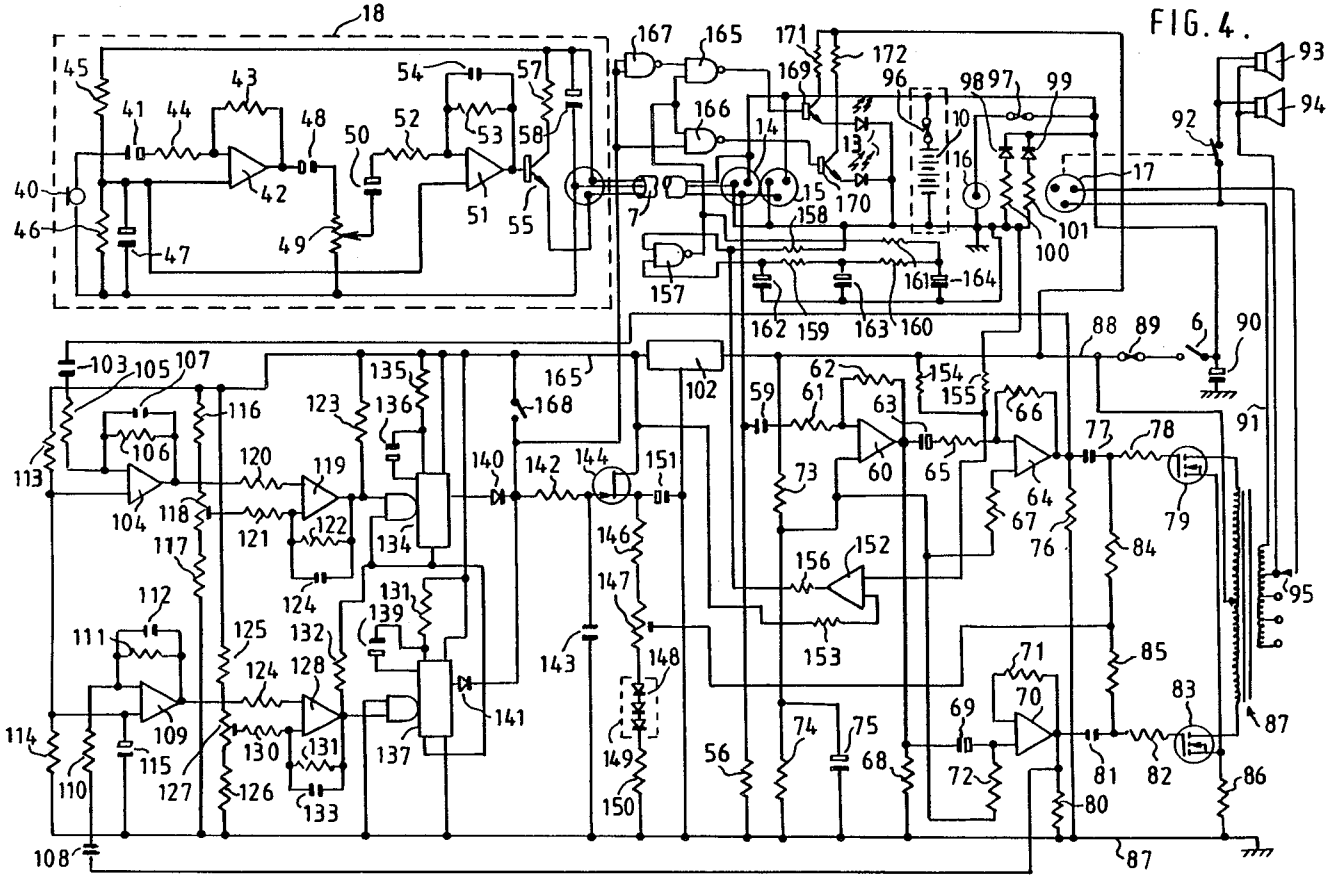
FIG. 4 is a circuit diagram of the amplifier of FIG. 1.

FIG. 4 is a circuit diagram of the microphone electronics within the microphone body and of the amplifier electronics.

The microphone contains a microphone transducer 40 connected via a coupling capacitor 41 to an amplifier comprising an operational amplifier 42, a feedback resistor 43, and an input series resistor 44. Potential dividing resistors 45 and 46 and decoupling capacitor 47 provide a bias voltage for the non-inverting input of the operational amplifier 42. The output of the amplifier is connected via a coupling capacitor 48 to a potentiometer 49 controlled by the volume adjustment sleeve 21 on the microphone body so as to allow a user to adjust the volume or output level of the system from the microphone.

The output of the potentiometer is connected via a coupling capacitor 50 to a further amplifier stage comprising an operational amplifier 51, a series input resistor 52, a feedback resistor 53, and a feedback capacitor 54. The output of the amplifier 51 is connected to the base of a transistor 55 connected as an emitter follower with a remote emitter load resistor 56 and provided with a collector resistor 57 for limiting the maximum output current to a level within the operating range of the transistor. A capacitor 58 is provided to decouple the power supply to the microphone.

The microphone is connected via the cable 7 t the link sockets 14 and 15 so as to receive power from the output amplifier located within the enclosed lid 2 and so as supply the amplified signal from the microphone to the output amplifier. The signal from the microphone is developed across the resistor 56 and supplied via a coupling capacitor 59 to the input of a amplifier stage comprising an operational amplifier 60, a series input resistor 61, and a feedback resistor 62. The output of the amplifier stage 60 is supplied via a capacitor 63 to the input of an inverting driver stage comprising an operational amplifier 64 and resistors 65, 66, and 67. The output of the amplifier stage 60 is also supplied across a resistor 68 and via a coupling capacitor 69 to a non-inverting driver stage comprising an operational amplifier 70 and resistors 71 and 72. Potential divider resistors 73 and 74 and decoupling capacitor 75 provide a reference voltage for the non-inverting inputs of the operational amplifiers 60, 64, and 70.

The output of the inverting driver stage is supplied across a resistor 76 and via a capacitor 77 and a resistor 78 to the gate of a power MOSFET 79. Similarly, the output of the non-inverting driver stage is supplied across a resistor 80 and via a capacitor 81 and a resistor 82 to the gate of a power MOSFET 83. The gates of the power MOSFETs 79 and 83 ar provided with a bias voltage via resistors 84 and 85 as will be described hereinafter. The sources of the power MOSFETs 79 and 83 are connected together and via a resistor 86 to the common supply line 87. The drains of the power MOSFETs 79 and 83 are connected to opposite ends of the primary winding of a transformer 87. The primary winding has a center tap connected to a positive supply line 88 provided with a fuse 89 and connected to the on/off switch 6. A power supply decoupling capacitor 90 is also provided. Thus, the power MOSFETs 79 and 83 and the transformer 87 constitute a push-pull output stage of the output amplifier.

The transformer 87 has a multi-tapped secondary winding, a common end of which is connected via a line 91 to one terminal of the external loudspeaker socket 17 and via a switch 92 to the parallel-connected internal loudspeakers 93 and 94. The loudspeakers 93 and 94 are connected to one of the taps of the secondary winding. The switch 92 is arranged so that it is opened when a plug is inserted into the socket 17. A second terminal of the socket 17 is connected to a jump lead 95 for selecting the appropriate secondary winding tap. These may be arranged to provide suitable matching to 4 ohm, 8 ohm, 16 ohm, and 100 volt external loudspeakers.

The rechargeable battery pack 10 is connected in series with a fuse 96 between the common line 87 and the switch 6. Similarly, the socket 16 is connected in series with a fuse 97 between the common line 87 and the switch 6. Diodes 98 and 99 and series-connected resistors 100 and 101, respectively, are connected between the common line 87 and the switch 6. During correct operation, the diodes 98 and 99 are reversed-biased. However, in the event that a power supply is connected to the socket 16 with the Wrong polarity, the diodes 98 and 99 conduct via the resistors 100 and 101 causing a current to flow which blows the fuse 97, so as to protect the electronics from incorrect power supply polarity.

A three terminal integrated circuit voltage regulator 102 supplies power to a battery saver and output stage bias circuit so that this circuit can tolerate large power supply voltage fluctuations.

The output of the inverting driver stage is connected via a capacitor 103 to an amplifier comprising an operational amplifier 104, an input resistor 105, a feedback resistor 106, and a capacitor 107. Similarly, the output of the non-inverting driver is connected via a capacitor 108 to an amplifier comprising an operational amplifier 109, an input resistor 110, a feedback resistor 111, and a feedback capacitor 112. Potential dividing resistors 113 and 114 and a decoupling capacitor 115 provide a reference voltage for the noninverting inputs of the operational amplifiers 104 and 109. The output of the operational amplifier 104 is connected to one input of a comparator whose other input is connected to receive a variable threshold voltage from an adjustable potential divider comprising resistors 116 and 117 and a variable resistor 118. The comparator comprises an operational amplifier 119, resistors 120 to 123, and a capacitor 124. Similarly, the output of the operational amplifier 109 is connected to a first input of a comparator whose second input receives an adjustable threshold voltage from a potential divider comprising resistors 125 and 126 and an adjustable resistor 127. The comparator comprises an operational amplifier 128, resistors 129 to 132, and a capacitor 133.

The output of the comparators are connected so as to trigger first and second re-triggerable monostable multivibrators having periods of five hundred and three hundred milliseconds, respectively. The first monostable multivibrator comprises an integrated circuit 134, a timing resistor 135, and a timing capacitor 136. The second monostable multivibrator comprises an integrated circuit 137, a timing resistor 138, and a timing capacitor 139.

The outputs of the monostable multivibrators are connected together via respective diodes 140 and 141 to provide the output of the battery saver circuit. This output is connected via a resistor 142 provided with a timing capacitor 143 to the gate of a field effect transistor 144 whose drain is connected to the regulated positive supply line 145. The effect of the timing capacitor 143 is to slow down switching off of the output stage. The source of the field effect transistor 144 is connected to the common line via a series circuit comprising a resistor 146, an adjustable resistor 147. diodes 148 attached to a heat sink 149 to which the power MOSFETs 79 and 83 are attached, and a resistor 150. A decoupling capacitor 151 is connected between the source of the field effect transistor 144 and the common line 87. The slider of the adjustable resistor 147 is connected to the resistors 84 and 85 so as to provide the bias voltage for the power MOSFETs 79 and 83.

An operational amplifier 152 arranged as a comparator has a first input connected via a resistor 153 to the regulated supply line 145 and a second input connected to a potential divider connected between the common line 87 and the supply line 88 and comprising resistors 154 and 155. The output of the operational amplifier 152 is connected via a resistor 156 to one input of a NAND gate 157 and via a resistor 158 to the common line. The gate 157 is provided with a phase-shift feedback network comprising resistors 159, 160, and 161 and capacitors 162. 163 and 164 so as to comprise a gated oscillator with a frequency of 1 Hz. The output of the gate 157 is conneted to first inputs of NAND gates 165 and 166. The other input of the gate 165 is connected to the output of the gate 167 connected as an inverter. The inputs of the gate 167 and the other input of the gate 166 are connected to the output of the battery saver circuit, which is also connected to one terminal of a test switch 168 whose other terminal is connected to the regulated supply line 145. The outputs of the gates 165 and 166 are connected to the bases of transistors 169 and 170, respectively, whose collectors are connected via resistors 171 and 172, respectively, to the positive supply line 88 and whose emitters are connected via red and green light emitting diode sections of the indicator 13 to the common line 87.

In order to deploy the public address amplifier, the lid is opened and the switch 6 turned on so as to supply power to the positive supply line 88. The red light emitting diode section of the indicator 13 is illuminated to indicate this. The lid 2 may then be fastened to the base 1 so as to prevent unauthorised tampering. If the voltage of the battery 10 or an external power supply connected to the socket 16 is sufficiently high to provide adequate power, the comparator formed by the operational amplifier 152 holds of its the oscillator formed around the gate 157. However, if the power supply voltage falls below a predetermined value, for instance, 11 volts in the case of a twelve volts battery supply, the operational amplifier 152 enables the gate 157 to oscillate so that both light emitting diode sections of the indicator 13 flash to give a yellow output at a frequency of 1 Hz.

In the absence of signals at the link sockets 14 from the microphone 18 or from elsewhere, the inverting and non-inverting driver stages supply no signals to the amplifiers built around the operational amplifiers 104 and 109. The first and second monostable multivibrators remain untriggered and their outputs hold the field effect transistor 144 off. The voltage at the slider of the adjustable resistor 147 is therefore close to the potential of the common line 87 and the power MOSFETs 79 and 83 are turned off. In these conditions, the current drawn from the battery 10 is very low. As soon as signals of sufficient amplitude arrive at the link sockets 14 and 15, the driver stages supply signals to the operational amplifiers 104 and 109 and the comparators formed around the operational amplifiers 119 and 128 trigger the monostable multivibrators, which remain triggered until 500 milliseconds after the last input signal was received. The monostable multivibrators turn on the field effect transistor 144 so that a predetermined bias voltage is supplied from the wiper of the adjustable resistor 147 to the gates of the power MOSFETs 79 and 83. For instance, the adjustable resistor 147 is adjusted to provide a quiescent or standing current of 250 milliamps so that the output stage operates in class AB1. The red light emitting diode section is extinguished and the green light emitting diode section is illuminated to indicate that the amplifier is in its active mode. The switch 168 is provided for initial setting up and allows the field effect transistor 144 to be held on so that the bias voltage for the output stage can be adjusted.

If it is desired to provide a public address system of greater power, two or more public address amplifiers may be linked together by means of the link sockets 14 and 15. Each socket has a first terminal connected to the common line 87, a second terminal connected to the positive terminal of the battery 10 or external power supply plugged into the socket 16, and a third terminal connected to the emitter of the transistor 55 and to the emitter load resistor 56. In order to connect two public address amplifiers together, the first, second and third terminals of one of the link sockets on one amplifier are connected to the first, second, and third terminals, respectively, of one of the link sockets on the other amplifier. The signal from the emitter of the transistor 55 is supplied to both amplifiers and is developed across the resistor 56 in each amplifier. The volume of both amplifiers is controlled by the single sleeve 21 on the microphone 18.

If two or more microphones are required, they may be connected to a separate mixer into which the cable 7 is plugged. Such a mixer may receive power via the cable 7. Alternatively, each microphone may be connected to a cable via an adaptor which contains an emitter load resistor for the emitter follower and an isolating resistor in series with the signal lead.

The power supply lines of both amplifiers are connected in parallel. This means that a public address amplifier containing a discharged battery 10 can nevertheless function by drawing power from the connected amplifier whose battery is adequately charged. Where many public address amplifiers are connected together via the link sockets 14 and 15, signals and power are shared between all such amplifiers and discharge of the battery or other failure of one amplifier does not affect the remainder of the system. Also, the cabling requirements are reduced to a minimum since the system can be expanded merely by connecting a link socket on an additional amplifier to a spare link socket on an existing amplifier of the system.

In order to recharge the battery pack 10 it may be removed and connected to a conventional charger. However, it may be more convenient to connect a charger to one of the link sockets 14 and 15. By interconnecting several amplifiers by means of the link sockets, with one of them being connected to a battery charger, all such batteries may be recharged simultaneously. Of course, the amplifiers are switched off during charging.

In a public address system where a single microphone is required but several amplifiers are to be deployed, the system ma most easily be assembled by connecting the cable 7 of one amplifier to the microphone 18 and connecting the cable 7 of each other amplifier to one of the link sockets 14 and 15 of an adjacent amplifier. Thus, the amplifiers provide all the cabling necessary to set up the system and a user can make the necessary connections easily and without requiring any technical knowledge. When the system is taken down all the cables are retracted into their cases, and no additional loose cables need be provided. If more than one microphone is required, some additional cables for connecting together link sockets of different amplifiers may be needed. Additional microphones 18 ca be plugged into link sockets at any point in the system and will drive all amplifiers of the system. The only user-adjustable control is the volume adjustment sleeve 21 at each microphone in use, so that no expert adjustments are required when setting up the system.

The battery saver circuit in each amplifier causes each amplifier in the system to return to a standby mode when no signals are supplied at any point in the system. Battery consumption is therefore greatly reduced, thus prolonging the period between charging. Further the problems of feedback or "howl round" are reduced by this automatic shutting down of the amplifiers in the absence of signals. For instance, if speech signals are received by the amplifiers for 50% of the time during which the amplifiers are switched on, the battery life or period between recharging is almost doubled. The battery saver circuit restores operation sufficiently quickly for minimal and imperceptible loss of the signal when the amplifier changes from standby mode to active mode.

The number of amplifiers which may be linked together is limited essentially by the current drive capability of the microphone output stage and the value of the load resistor 56 in the amplifiers. In practice, it has proved possible to select these values such that 200 units may be linked together for simultaneous operation. In the case of an amplifier output power of 30 watts RMS, any size of public address system up to 6,000 watts RMS may easily be provided and the amplifiers may be located together, in groups at different places, or individually at different places in accordance with the requirements of the system.

I claim:

1. A public address amplifier comprising a housing; an output amplifier located in said housing, said output amplifier having an input for receiving pre-amplified signals, an output for supplying amplified signals to at least one loudspeaker, and a power input for receiving power from a power source; a cable for extending from said housing, one end of said cable being coupled to said power input so that power can be carried by said cable, and said one end of said cable being coupled to said input for receiving pre-amplified signals also carried by said cable; and a terminal on said housing coupled to said power input so that power can be supplied from said terminal, said terminal also being coupled to said input for receiving said pre-amplified signals so that said pre-amplified signals can be supplied from said terminal; a connector connected to the other end of said cable; whereby at least one further public address amplifier having the same configuration as said public address amplifier can be coupled serially with said public address amplifier by connecting a corresponding connector of the further public address amplifier into said terminal of said public address amplifier, whereby each of said public address amplifier and said further public address amplifier can receive said pre-amplified signals from a single pre-amplifier which can be connected to said connector of the public address amplifier, and whereby each public address amplifier and the pre-amplifier can receive power from any one of said public address amplifiers.

2. A public address amplifier as claimed in claim 1, further comprising a microphone body containing said pre-amplifier, a microphone transducer located in said microphone body and connected to an input of said pre-amplifier.

3. A public address amplifier as claimed in claim 2, in which said pre-amplifier has a manually adjustable gain control which is operable at said microphone body.

4. A public address amplifier as claimed in claim 2, in which said one end of said cable is captive in said housing, and said housing contains manual winding means for winding said cable into said housing and clutch means for disengaging said manual winding means when said cable is pulled out of said housing.

5. A public address amplifier as claimed in claim 2, in which said pre-amplifier includes an output stage which is operative for providing a current drive output signal and said housing contains a load resistor for said output stage, whereby each of said public address amplifiers generates the same level of amplified signal in response thereto.

6. A public address amplifier as claimed in claim 1, in which said output amplifier includes bias control means for reducing quiescent current of said output amplifier in the absence of a signal at said input of said output amplifier; and rechargeable battery means is located within said housing for supplying power to said power input.

7. A public address amplifier as claimed in claim 1, further comprising power supply connection means located at said housing for permitting connection of an external power supply to said power input.

8. A public address amplifier as claimed in claim 1, further comprising at least one loudspeaker located within said housing and connected to said output of said output amplifier.

* * * * *